US007811117B2

(12) United States Patent
Andrade

(10) Patent No.: US 7,811,117 B2
(45) Date of Patent: Oct. 12, 2010

(54) CORD FASTENING SYSTEM AND METHOD

(76) Inventor: Kirk Andrade, 10 Milland Dr., #A24, Mill Valley, CA (US) 94941

( * ) Notice: Subject to any disclaimer, the term of this patent is extended or adjusted under 35 U.S.C. 154(b) by 1156 days.

(21) Appl. No.: 11/279,993

(22) Filed: Apr. 17, 2006

(65) Prior Publication Data

US 2009/0064465 A1 Mar. 12, 2009

(51) Int. Cl.
*H01R 13/62* (2006.01)

(52) U.S. Cl. ..... 439/373

(58) Field of Classification Search ..... 439/369, 439/370, 371, 373; 174/53, 66, 67, 135; 248/60, 62

See application file for complete search history.

(56) References Cited

U.S. PATENT DOCUMENTS

| | | | | | |
|---|---|---|---|---|---|
| 3,115,541 | A | * | 12/1963 | Hanner et al. | 174/92 |
| 3,499,103 | A | | 3/1970 | Pearce | |
| 4,440,465 | A | * | 4/1984 | Elliott et al. | 439/369 |
| 4,690,476 | A | * | 9/1987 | Morgenrath | 439/502 |
| 4,907,984 | A | * | 3/1990 | Keller | 439/369 |
| 5,044,976 | A | | 9/1991 | Thompson | |
| 5,061,194 | A | * | 10/1991 | Herman et al. | 439/133 |
| 5,139,429 | A | * | 8/1992 | Herman et al. | 439/133 |
| 5,336,107 | A | * | 8/1994 | Sheryll | 439/369 |
| 5,348,495 | A | | 9/1994 | Kasden | |
| 5,547,390 | A | | 8/1996 | Laherty | |
| 5,913,693 | A | * | 6/1999 | Fetterolf | 439/369 |
| 6,036,526 | A | * | 3/2000 | Alfis, III | 439/369 |
| 7,470,141 | B2 | * | 12/2008 | Yoest | 439/369 |
| 7,484,990 | B1 | * | 2/2009 | Lee et al. | 439/369 |
| 2003/0139085 | A1 | | 7/2003 | Lin | |
| 2003/0157824 | A1 | | 8/2003 | Ito | |
| 2004/0166718 | A1 | | 8/2004 | Yoest | |
| 2009/0064465 | A1 | * | 3/2009 | Andrade | 24/115 H |

OTHER PUBLICATIONS

Kord-O-Lock Product Information (Dec. 2007).
Kord Manager Cord Lock Information (Dec. 2003).
Kord Manager Carry Strap Information (Mar. 2008).
Co-pending U.S. Appl. No. 12/433,511, filed Apr. 30, 2009.

* cited by examiner

*Primary Examiner*—James Harvey

(57) ABSTRACT

A system and method for providing cord fastening (CF) so Industrial, Commercial and Home users (ICAHUs) can assure that cords, including but not limited to electrical cords, cannot be accidentally unplugged. The system and method allows ICAHUs to work safely and efficiently and to avoid cords that may accidentally unplug themselves in the course of everyday use. ICAHUs can easily apply collar mechanisms to the end of cords aft of said cord's respective plug ends, and then subsequently attach said collar mechanisms together using a series of collar ties that are adjustable in length and tension, and tie connectors which facilitate said adjustment of said collar ties. The method comprises a system in which standard electrical cords may be fastened together then held tightly together without easily becoming accidentally unplugged.

18 Claims, 5 Drawing Sheets

CORD FASTENING SYSTEM AND METHOD

OTHER APPLICATIONS

This application is commonly-owned with co-pending U.S. patent application Ser. No. 12/433,511.

FIELD OF THE INVENTION

The present invention is in the field of Industrial, Commercial and Home use, specifically a system and method to safely fasten a cord, including but not limited to an electrical cord, to another cord. Said cords may include but shall not be limited to either a stand-alone electrical cord and/or an electrical cord attached to an electrical device such as a power tool or appliance. Said invention shall assure that said cords remain connected in the course of normal use and do not become unplugged from one another.

BACKGROUND OF THE INVENTION

Today, it is necessary for Industrial, Commercial and Home users (ICAHUs) of tools and systems, including but not limited to electrical tools, electrical appliances and computer systems to work safely and efficiently. Often, cords, including electrical cords, may accidentally unplug themselves in the course of everyday use; thus, creating an inconvenience and possibly a safety hazard. To avoid said cords from unplugging, ICAHUs often tape electrical cords together or take time to "wire them" or "rig them" together, or just plug them in and hope they don't become accidentally unplugged. Cords becoming unplugged can be hazardous, such as in the loss of power to a device, and scrambling around to plug in cords that become unplugged can be time consuming. For this reason and others, this present invention, a cord fastening (CF) system and method will easily accommodate and facilitate that said cords used by ICAHUs stay connected during use.

ICAHUs need to work safely and efficiently. Moreover, an electrical device needs to remain plugged-in to be able to receive electricity to function. Time used to plug-in electrical devices that become unplugged is wasted. ICAHUs also may need to move within a work environment in which electrical cords may become snagged or caught on objects and could become disconnected. With the CF system and method, ICAHUs can easily fasten electrical devices together to assure they remain plugged in.

In addition, because of the need for ICAHUs to work safely and efficiently, companies such as Home Depot, Ace Hardware, Home Club, Sam's Club, K-Mart, Sears, Stanley, Loews and Costco, may more-than-likely desire to sell the cord fastening system and method that is comprised in this invention, as a stand alone product or in combination with cords, electrical cords and power devices, including but not limited to power tools.

Heretofore, inventors have not created and developed a system and method for facilitating cord fastening that will fit easily on standard cords, including but not limited to standard electrical cords, and that will actually hold them securely during the stresses and demands encountered in a work environment. This invention permits said ICAHUs to employ the CF system and method easily with many types of cords, including standard, electrical cords that typically contain male and female connectors or plug ends that fasten by fitting the male connector into the female connector by using direct pressure without the need for any twisting of the connectors or their parts.

U.S. Pat. No. 2003/0157824 (Ito, August 2003), expressly incorporated herein by reference, relates to a method for a Power Cord Connecting Set which is similar to a cord fastening system and method. This existing art is for specific type of plug set, both male and female, and is not able to be easily fastened to existing standard electrical cords without replacing the actual plug ends of said electrical cords with specialized and customized plug ends. Moreover the existing art will not allow itself to be easily removed from one set of electrical cords and then transferred to another without either heavy modification, and/or possibly running the existing set of plug ends. The existing art is specifically a type of complex plug end that is not simple in nature as opposed to this present invention which is not a plug end but instead a cord fastening system that will not require the modification or alteration of plug ends and that may be easily moved from electrical cord sets to others.

U.S. Pat. No. 2003/0139085 (Chia Hsien, July 2003), expressly incorporated herein by reference, relates to a method for an Electric cord connector kit which is not particularly similar to the cord fastening system and method of this present invention, in that the Electrical cord connector kit is a kit used to "splice" together actual electrical cords and to join then together by crimping them, and is not designed to "plug" and "unplug" or to hold standard electrical plugs in place. This existing art is for permanently joining together electrical cords and is quite different form this present invention in design and scope.

U.S. Pat. No. 5,044,976 (Thomson, 1991) expressly incorporated herein by reference, relates to an electrical cord holding device that possesses a hook-and-loop fastening mechanism that protrudes from, and is secured to, a cover plate, and a reciprocal second portion of a hook-and-loop fastening mechanism that is clamped onto a power cord, wherein the first and second portions of the hook-and-loop fastening mechanism assist in retaining a plug within an outlet. This existing art is specifically for connecting electrical cords into wall outlets and is entirely different in its scope and design from this present invention that is designed to securely maintain that cords are connected together, with a focus on plug ends or plug heads as are standard on electrical extension cords and electrical devices, such as is the engagement of a female plug head of an extension cord to the male plug head of a corded power tool or appliance.

U.S. Pat. No. 5,348,495 (Kasden, 1994) expressly incorporated herein by reference, relates to an "electrical cord plug lock assembly having a special electrical socket face plate with a pair of laterally spaced locking brackets extending outwardly from its front surface adjacent the opposite sides of the socket aperture." This existing art is specifically for connecting electrical cords into wall outlets and is entirely different in its scope and design from this present invention that is designed to securely maintain that cords are connected together, with a focus on plug ends or plug heads as are standard on electrical extension cords and electrical devices, such as is the engagement of a female plug head of an extension cord to the male plug head of a corded power tool or appliance.

U.S. Pat. No. 5,547,390 (Laherty, 1996) expressly incorporated herein by reference, relates to an "electrical plug securing device provides a length of material and embodies appendages into which are formed slots". This existing art is specifically for connecting electrical cords into wall outlets and is entirely different in its scope and design from this present invention that is designed to securely maintain that cords are connected together, with a focus on plug ends or plug heads as are standard on electrical extension cords and electrical devices, such as is the engagement of a female plug head of an extension cord to the male plug head of a corded power tool or appliance.

U.S. Pat. No. 2004/0166718, (Yoest, Daniel, August 2004), expressly incorporated herein by reference to a method for a power cord plug securing device is somewhat similar in purpose to the cord fastening system and method of this present invention, in that it is a system and method for securing power cords together; however, the existing art by Yoest claims the use of a "clasp member" that is "substantially U-shaped" in order to attach itself to an electrical cord, and in the present invention, a multiple-piece collar mechanism is used that is more secure. Also, in the existing art by Yoest, said "clasp member comprises a trough region with retaining walls extending therefrom, said retaining walls terminating in inwardly projecting ends for securely maintaining the portion of the power cord immediately aft of the plug head within said through region" which is markedly different from what is claimed in this present invention, in which a multiple-piece collar mechanism is used. Moreover, the existing art claims a device in which "at least one of said trough region and said retaining walls are at least partially textured or ribbed for increased frictional association with the portion of the power cord retained therein" which indicates that texture and ribbing are employed to create friction as a means of attaching a clasp to a power cord and retaining said power cord; however, in this present invention, what is claimed is the attachment of a multiple-piece collar mechanism to connect to a cord which is markedly different and uses pressure created by the use of fasteners and/or a snap-together hold to accomplish securing said multiple-piece collar mechanism to said cord, which is expected to secure more strongly to said cord than said existing art and therefore will out-perform said existing art. Moreover, existing art claims a "securing strap" which is formed out of one-piece that is also is joined by a "clasp member" on each respective end. Said "securing strap" is not adjustable and is a singular piece which posed two problems: 1) because said "securing strap" is not adjustable it may not fit on a myriad of power cords that employ different types and sizes of male/and or female plug ends; and 2) because said "securing strap" is a singular piece, it may be prone to failure in that it would be weakest in retaining connected cords when pressure was applied from the direct edge of the "securing strap" that was opposite from the cord, then applied inward toward said cord. This present invention claims collar ties that are superior to "securing straps" because they are adjustable and therefore will fit a myriad of cords types and sizes. Moreover, this present invention claims the use of multiple collar ties so that they will be able to withstand the pressure that is applied to cords in a work environment, such as construction or carpentry, without having them become disconnected. Furthermore, this invention claims a multi-piece collar mechanism that is markedly different from the existing arts claim of a "clasp member" that is "substantially U-shaped" employing a "trough region" in that said "clasp member" of existing art allows for said cord to be unseated and thereby removed from said "trough" of the "clasp member" when exposed to pressure, since it does not close around said cord and allows said cord to "pop-out"—thereby failing in its objective; whereby, said cord will not be allowed to become either unseated or removed from said collar mechanism of the present invention when exposed to pressure since said cord is fully enclosed by said collar mechanism—thereby succeeding in its original purpose and objective.

Accordingly, existing inventions describe methods and systems for assuring that electrical cords remain plugged-in or connected, but there does not appear to be an invention that possesses all the features and components of our system and method for delivering a cord fastening solution as in this present invention. To summarize, the systems and methods of the existing inventions have one or more of these disadvantages:

- Existing art is not easy-to-use and requires modifying plug ends of electrical cords.
- Existing art requires replacing standard plug ends on cords with specialized or customized plug ends and therefore cannot be easily removed from one cord or device to another.
- Existing art employs the use of "clasps" to attach to a plug that rely on friction; but that ultimately will allow cords to "pop-in" and "pop-out" of said clasp as pressure is applied, thereby failing to secure said cord is dragged or pulled during working conditions and an obstacle or impediment snags cord creating pressure on "clasps".
- Existing art employs clasps that are "open" in that they do not surround the cord they attach to but allow the cord an area in which it may "pop-out" of clasp when under pressure.
- Existing art employs a singular securing strap that is not adjustable and therefore will not fit numerous types and sizes for male and female connectors and other connectors as are used on multiple cord configurations.
- Existing art employs a singular securing strap that will not allow it to offset pressure paced upon cords when they are under stress during work conditions.

SUMMARY OF THE INVENTION

The present invention relates to a system and method enabling a cord to remain connected to another cord and not to become accidentally unplugged while being used by Industrial, Commercial and Home users (ICAHUs) of electrical tools and appliances. Said invention allows ICAHUs to work safely and efficiently. This present invention, a cord fastening (CF) system and method will easily accommodate and facilitate that said cords used by ICAHUs stay connected during use.

This present invention will be described further in preferred embodiments, and it overcomes all of the above-mentioned disadvantages of today's existing art. This invention secures cords together and provides an ideal solution for securely assuring that a cord plug remain plugged into either an extension cord or a device with a similar cord such as a power tool; thereby, assuring that the cords will not become disconnected.

Broadly stated, this present invention is a cord fastening system and method that in its best mode form has multiple collar pieces that can fasten together to connect to a cord, multiple collar ties that are adjustable and tie connectors that can lock and unlock from each other in order to allow collar ties to adjust in order to create tension and thereby hold the cords together.

In greater detail, this present invention, in its preferred form, is a cord plug securing device having collar pieces that fasten together to connect to a cord and that may be fastened together by means, including but not limited to: screws, screwing through holes in one collar and screwing into another; bolts, protruding through one collar and screwing into either the opposite collar or into a nut embedded in the opposite collar; a snap hold, in which a two collar pieces are adjoined on one edge and in which the opposite edge is able to close down and thereby crimp the cord, holding it, and in which a protrusion on one edge of the collar opposite the adjoined edge is snapped over the adjoined collar onto its edge opposite the adjoined edge. The collar mechanisms of this present invention are designed to fully enclose around the cord and therefore shall not allow for an area in which the cord may "pop-out" or escape the collar as is the case with existing art. Moreover, collar ties are connected to collar pieces and may be connected by means, including but not limited to, placing a rivet in said collar tie and then sliding said collar tie into a tapered groove in said collar until said rivet seats itself in said tapered groove, thereby becoming fastened. Said collar ties may be made out of numerous types of material including but not limited to woven fabric or mesh-type material. Said collar ties connect to tie connectors that may use numerous configurations including but not limited to male and female buckles, snap-together assemblies or other means. The purpose of the tie connectors are to allow said collar ties to be adjusted and to then hold to each opposite tie connector, in order to allow adjustable tension to be created and thereby held in order to transfer and thereby keep tension on the plug ends of cords that should remain connected to expedite the uninterrupted flow of electricity in the case of an electrical cord.

Accordingly, a feature and advantage of this present invention is its ability to prevent accidental or forced disconnection of cords and/or plug-ends from cords such as electrical cords. In other terms, this present invention assures that female plug and male plug head ends remain connected.

Various aspects, features, sub-methods, and advantages of the present invention will become more apparent from the detailed description, taken with the accompanying drawing, of preferred embodiments of the invention, which is presented for example only.

DETAILED DESCRIPTION OF THE PREFERRED EMBODIMENTS

The preferred embodiment of the present invention will now be described in even greater detail by reference to the following figures.

Figure 1:
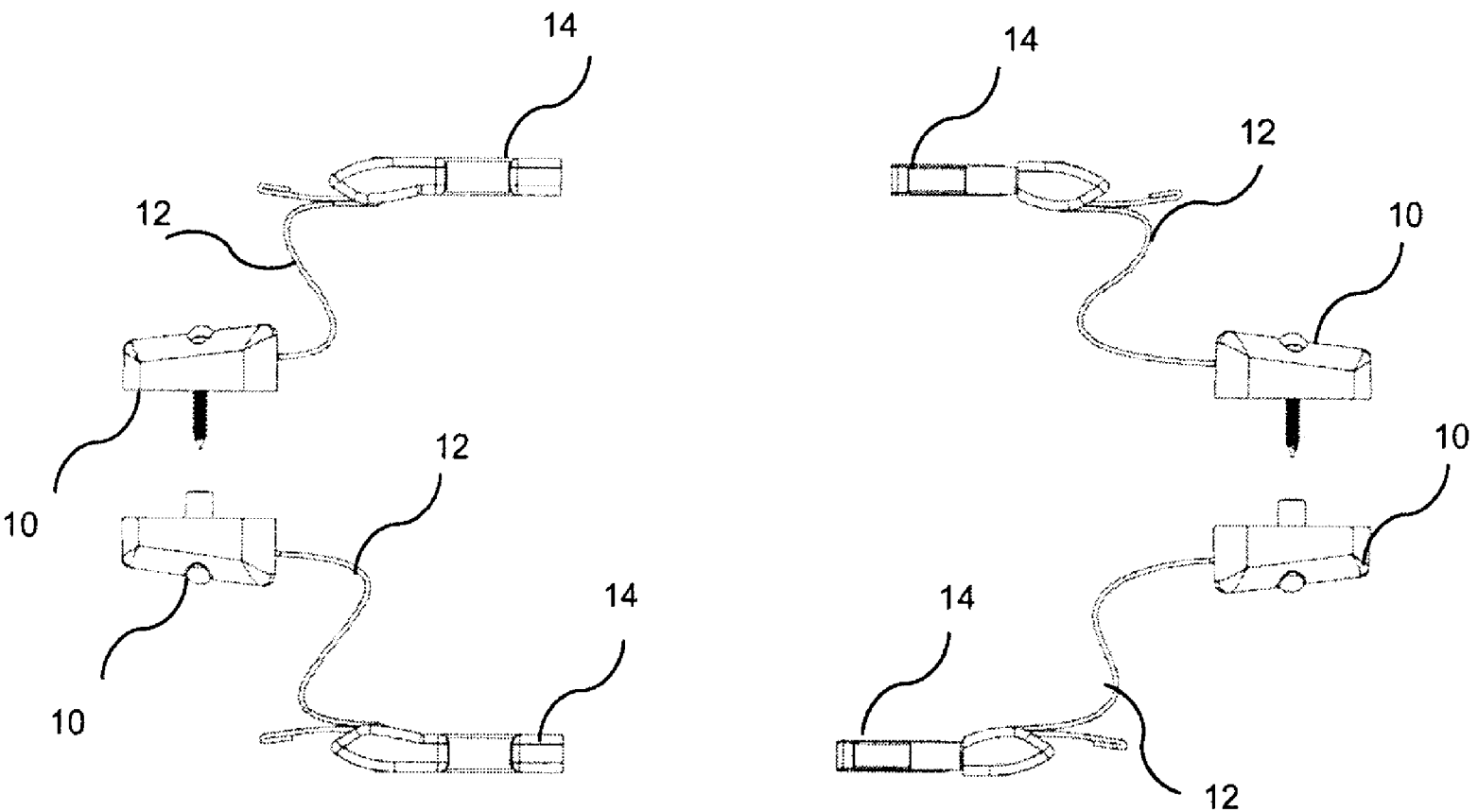
FIG. 1 is a drawing depicting the "Best Mode" Cord Fastening (CF) System and Method of the preferred embodiment in which a multiple-piece collar mechanism is employed.

FIG. 1 depicts the overall "Best Mode" Cord Fastening (CF) system and method of the preferred embodiment which includes a series of collars 10 that can be fastened together using a myriad of methods including but not limited to being screwed together using standard screws. Said collars 10 may also be snapped together or attached together by a multitude of connection means 58, as their function is still to connect to a cord in order to hold the cord and to create a place to connect to a collar tie 12, which fits between said collar 10 and also fastens to an tie connector 14 that may be designed in a fashion, including but not limited to a male into female plastic-type buckle, a snap connector, or other means. Here, the connection means 59 is depicted as a screw. In any case, said tie connectors 14 are designed to connect to each other and said collar tie 12 is designed to be adjustable to remove slack between said collar 10 and said tie connector 14, which thereby is able to create pressure that will aid in assuring that cords that are "plugged into" each other and/or connected to each other, remain so.

Figure 2:
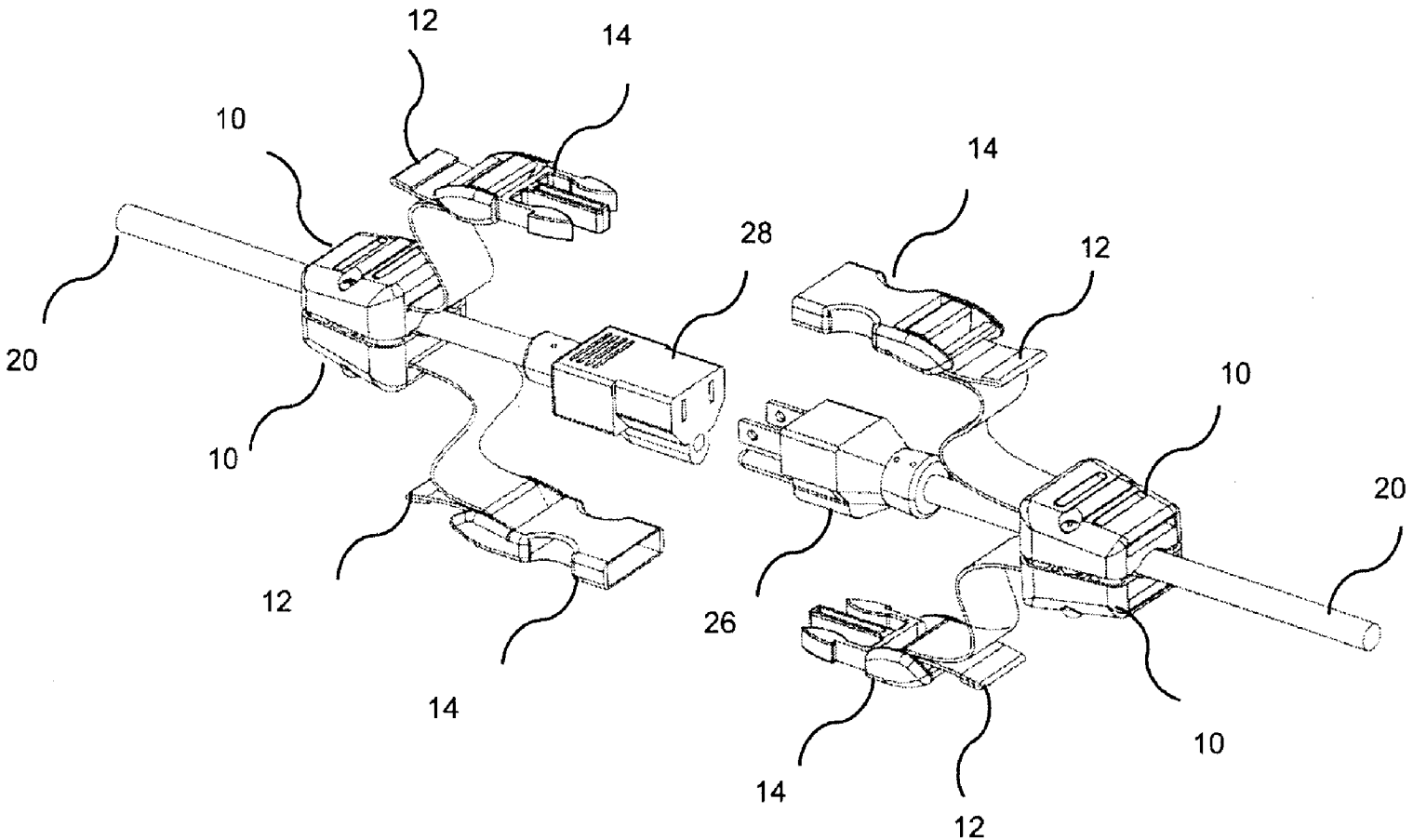
FIG. 2 is a drawing depicting a mode of the Cord Fastening (CF) System and Method, including Cord, of the preferred embodiment.

FIG. 2 depicts the overall Cord Fastening (CF) system and method, including cord, of the preferred embodiment which is similar to FIG. 1 and also includes a series of collars 10, collar ties 12, and tie connectors 14. Said collars 10, said collar ties 12, and said tie connectors 14 are arranged so that an electrical cord 20 can be fastened to another in a familiar way in which an electrical cord male plug 26 can be inserted into an electrical cord female plug 28, and whereby said collars 10 may fasten to said electrical cord 20, and in which said tie connectors 14 may attach to one another to then allow for adjustable collar ties 12 to be adjusted so slack in said collar ties 12 is reduced and so pressure is created to hold said electrical cord male plug 26 together with said electrical cord female plug 28, thereby not allow them to become unplugged and/or disconnected through normal use. Here, the collars 10 are held together using connections 58, which are depicted as screws, but may also be a snap hold connection or a nut and bolt pair.

Figure 3:
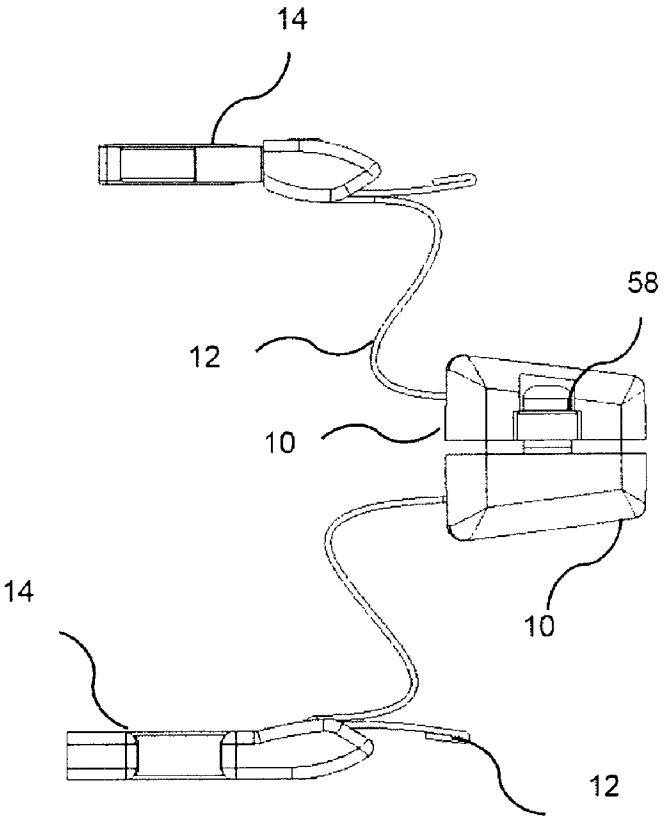
FIG. 3 is a drawing depicting the Cord Fastening (CF) System and Method, with a snap hold collar mechanism, of the preferred embodiment.
Figure 3:
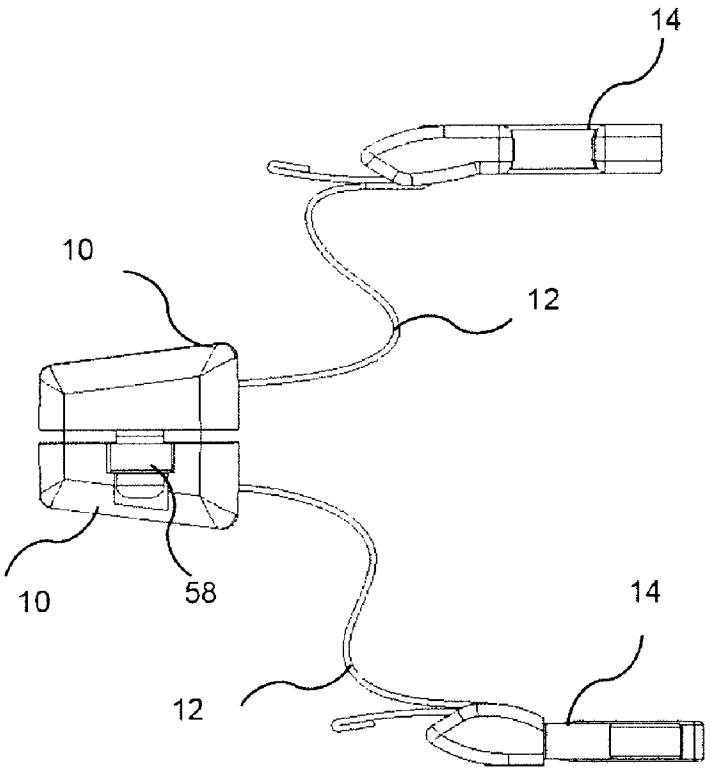

FIG. 3 depicts the Cord Fastening (CF) system and method with a snap hold of the preferred embodiment which includes a series of collars 10 that can be fastened together using a myriad of methods including but not limited to being screwed together using standard screws. Said collars 10 may also be snapped together using connections 58. Here, the connections 58 are snap holds that are molded into said collars 10 in which one collar is adjoined to another on one edge and design to fold over in order to connect to said cord, and whereby one edge opposite of the adjoined edge of said collar 10 is designed with a protrusion that will slide over an indentation in the one edge opposite of the adjoined edge of said adjoined collar 10 thereby forming a snap hold 30, thus allowing them to fasten to said cord. Collars 10 may also be attached together by a multitude of means, as their function is still to connect to a cord in order to hold the cord and to create a place to connect to a collar tie 12, which fits between said collar 10 and also fastens to an tie connector 14 that may be designed in a fashion, including but not limited to a male into female plastic-type buckle, a snap connector, or other means. In any case, said tie connectors 14 are designed to connect to each other and said collar tie 12 is designed to be adjustable to remove slack between said collar 10 and said tie connector 14, which thereby is able to create pressure that will aid in assuring that cords that are "plugged into" each other and/or connected to each other, remain so.

Figure 4:
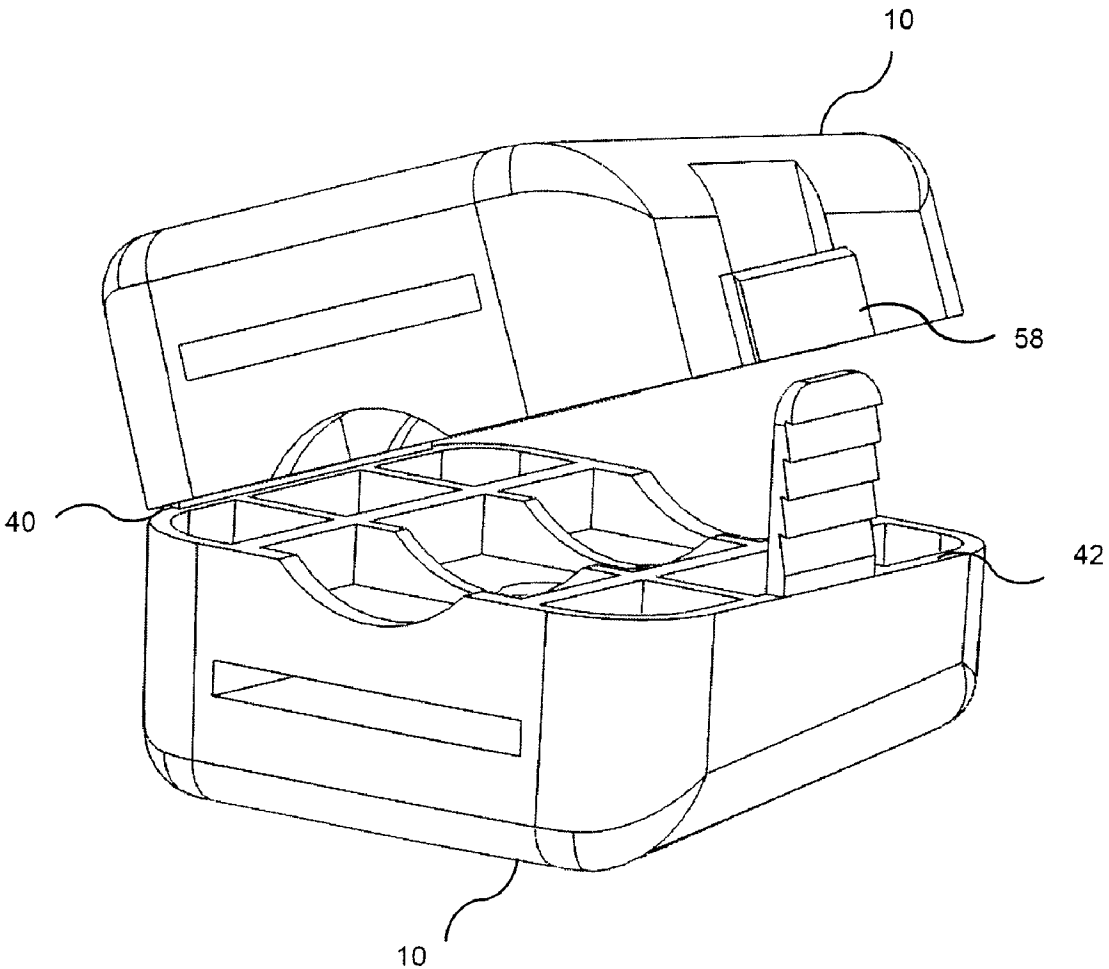
FIG. 4 is a drawing depicting a perspective View of a Collar Mechanism, with a snap hold, of the preferred embodiment.

FIG. 4 depicts a perspective View of a Collar Mechanism, with a snap hold, of the preferred embodiment, which displays a series of collars 10 that can be fastened together using connections 58. Here, the connections 58 are snap hold connections, which can be fastened and unfastened by snapping them and unsnapping them by the use of a the depicted snap hold that is molded into said collars 10 in which one collar is adjoined to another on one edge, the adjoined edge 40, whereby a design is formed to allow said collars to fold open, remaining adjoined at the adjoined edge 40, and whereby the edge opposite the adjoined edge 42 comes apart creating and area in which a cord may be inserted, before said collars 10 are moved toward each other and any distance between collars at said edge opposite adjoined edge 42 decreases and then said snap hold 30 is employed in order to connect said collar mechanism to said cord, thereby connecting to it securely, allow no area in which said cord can "pop-out" or escape said collar mechanism.

Figure 5:
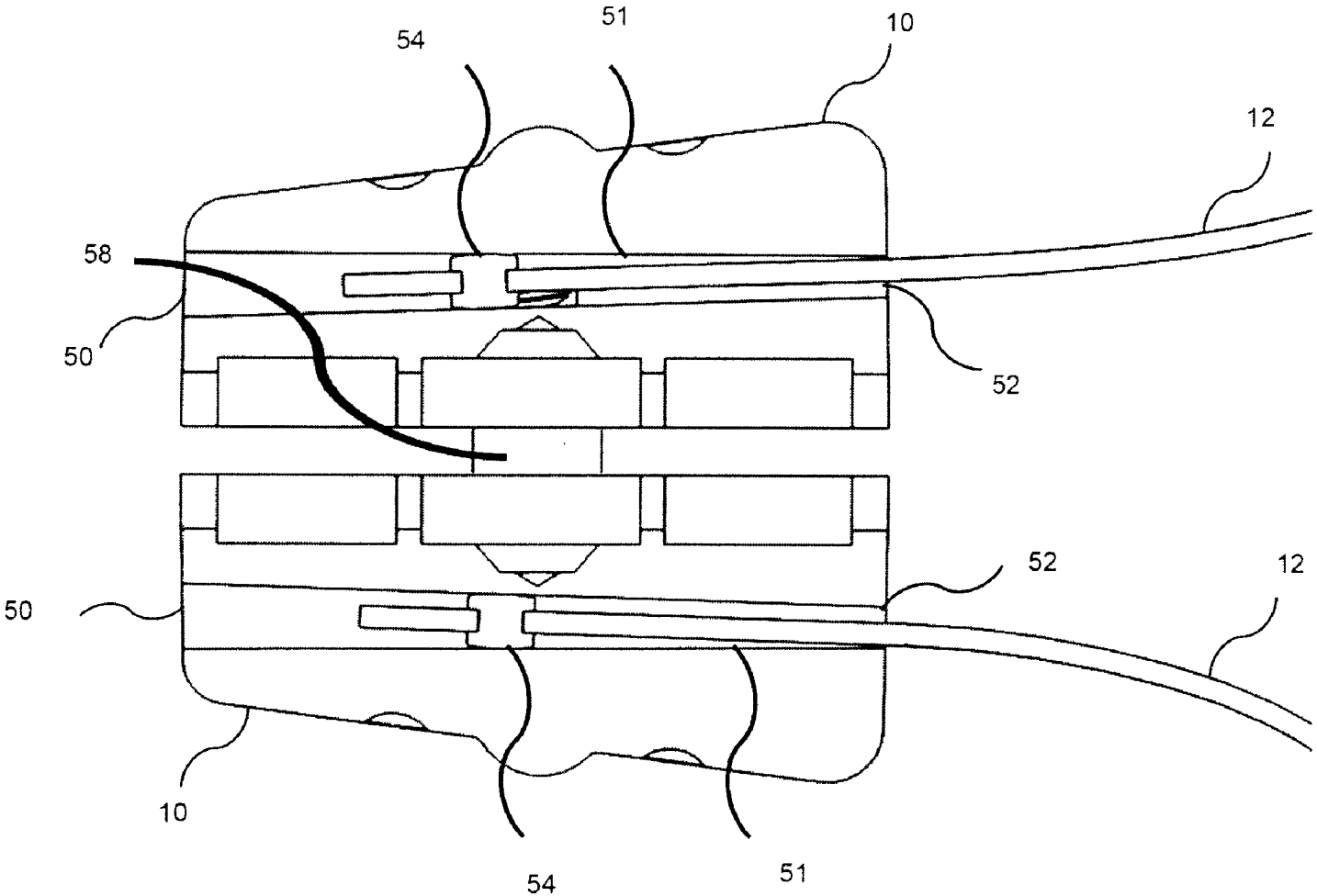
FIG. 5 is a drawing depicting a cross-section of one embodiment of the collar mechanism of the invention.

FIG. 5 is a cross section of one collar mechanism the comprises two collar pieces 10, which can be attached by a fastening mechanism 58, which can be, but is not limited to, a screw, a nut and bolt pair, or a snap-hold connection. Each collar piece has a tapered groove 51 having a large-sized end 50 and a small-sized end 52. A collar tie 12 is thread through the large-sized end 50 and out the small-sized end 52 of the tapered groove 51. The collar tie is held firmly in place by using a rivet 54 that will not fit through the small-sized end 52 of the tapered groove 51. When the collar ties 12 are fastened to a second collar tie 12 and adjusted, the collar mechanisms crimp down on the cord or wire, holding it in place so that it will not slide or move, and that the plug end of any electrical equipment is held safely and firmly attached to a plug in on a second cord.

What is claimed is:

1. A securing device, comprising:

a first plug head at an end of a first cord;

a second plug head at an end of a second cord;

a first collar mechanism configured to crimp around the first cord adjacent to the first plug head;

a second collar mechanism configured to crimp around the second cord adjacent to the second plug head;

a connector connected to the first collar mechanism and the second collar mechanism to secure the first plug head to the second plug head;

wherein the connector comprises:

a first collar tie connected to the first collar mechanism;

a first tie connector attached to the first collar tie;

a second collar tie connected to the second collar mechanism; and a second tie connector attached to the second collar tie, wherein the first tie connector is designed to lock with the second tie connector to fasten the first tie connector to the second tie connector; and wherein the first collar mechanism includes a tapered groove and the first collar tie includes a distended portion, wherein the distended portion is wedged within the tapered groove to connect the first collar tie to the first collar mechanism.

2. The device of claim 1, wherein the first collar tie comprises a mesh-type material.

3. The device of claim 1, wherein the distended portion comprises a rivet.

4. The device of claim 1, wherein the first collar mechanism comprises a first collar piece and a second collar piece wherein each of the first collar piece and the second collar piece includes a concave region to align with the first cord when the first collar mechanism is crimped around the end of the first cord.

5. The device of claim 4, further comprising a fastener to fasten the first collar piece and the second collar piece.

6. The device of claim 5, wherein the fastener comprises a screw, a nut and a bolt, or a snap-hold connection.

7. The device of claim 1, wherein the first collar mechanism comprises:

a first collar piece having a first edge and a second edge opposite the first edge;

a second collar piece having a first edge and a second edge opposite the first edge wherein the first edge of the first collar piece is adjoined to the second edge of the second collar piece;

a first snap hold portion connected to the first collar piece along the second edge; and a second snap hold portion connected to the second collar piece along the second edge wherein the first snap hold portion is designed to lock with the second snap hold portion to fasten the first collar mechanism onto the end of the first cord.

8. The device of claim 1, wherein the first collar tie is adjustable in length and tension.

9. The device of claim 1, wherein the first and second cords are selected from the group consisting of an indoor plug wire, an outdoor plug wire, a telephone plug wire, a LAN plug wire, a WAN plug wire, a cable wire, a data cable, and a coaxial cable; and wherein the first and second plug heads are selected from the group consisting of an industrial plug and an appliance plug.

10. A securing device, comprising:

a first collar mechanism configured to crimp around an end of a first cord;

a second collar mechanism configured to crimp around an end of a second cord; and a connector connected to the first collar mechanism and the second collar mechanism to secure the end of the first cord to the end of the second cord;

wherein the connector comprises:

a first collar tie connected to the first collar mechanism;

a first tie connector attached to the first collar tie;

a second collar tie connected to the second collar mechanism; and a second tie connector attached to the second collar tie, wherein the first tie connector is designed to lock with the second tie connector to fasten the first tie connector to the second tie connector; and wherein the first collar mechanism includes a tapered groove and the first collar tie includes a distended portion, wherein the distended portion is wedged within the tapered groove to connect the first collar tie to the first collar mechanism.

11. The device of claim 10, wherein the first collar tie comprises a mesh-type material.

12. The device of claim 10, wherein the distended portion comprises a rivet.

13. The device of claim 10, wherein the first collar mechanism comprises a first collar piece and a second collar piece wherein each of the first collar piece and the second collar piece includes a concave region to align with the first cord when the first collar mechanism is crimped around the end of the first cord.

14. The device of claim 13, further comprising a fastener to fasten the first collar piece and the second collar piece.

15. The device of claim 14, wherein the fastener comprises a screw, a nut and a bolt, or a snap-hold connection.

16. The device of claim 10, wherein the first collar mechanism comprises:

a first collar piece having a first edge and a second edge opposite the first edge;

a second collar piece having a first edge and a second edge opposite the first edge wherein the first edge of the first collar piece is adjoined to the second edge of the second collar piece;

a first snap hold portion connected to the first collar piece along the second edge; and a second snap hold portion connected to the second collar piece along the second edge wherein the first snap hold portion is designed to lock with the second snap hold portion to fasten the first collar mechanism onto the end of the first cord.

17. The device of claim 10, wherein the first collar tie is adjustable in length and tension.

18. A method of securing a connection between a first cord and a second cord comprising:

crimping a first collar mechanism around one end of the first cord, wherein the first collar mechanism is connected to a first collar tie and the first collar tie is attached to a first tie connector, and wherein the first collar mechanism includes a tapered groove and the first collar tie includes a distended portion wedged within the tapered groove to connect the first collar tie to the first collar mechanism;

crimping a second collar mechanism around one end of the second cord, wherein the second collar mechanism is connected to a second collar tie and the second collar tie is attached to a second tie connector; and fastening the first tie connector with the second tie connector to secure the first cord to the second cord.

* * * * *